US009279591B2

(12) United States Patent
Takata et al.

(10) Patent No.: US 9,279,591 B2
(45) Date of Patent: Mar. 8, 2016

(54) AIR-CONDITIONING APPARATUS

(75) Inventors: Shigeo Takata, Tokyo (JP); Koji Yamashita, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 719 days.

(21) Appl. No.: 13/394,518

(22) PCT Filed: Sep. 18, 2009

(86) PCT No.: PCT/JP2009/066377

§ 371 (c)(1),
(2), (4) Date: Mar. 6, 2012

(87) PCT Pub. No.: WO2011/033652

PCT Pub. Date: Mar. 24, 2011

(65) Prior Publication Data

US 2012/0168139 A1 Jul. 5, 2012

(51) Int. Cl.

| | |
|---|---|
| ***F24F 3/06*** | (2006.01) |
| ***F25B 13/00*** | (2006.01) |
| ***F25B 25/00*** | (2006.01) |

(52) U.S. Cl.

CPC ..... *F24F 3/065* (2013.01); *F25B 13/00* (2013.01); *F25B 25/005* (2013.01); *F25B 2313/0231* (2013.01); *F25B 2313/02732* (2013.01); *F25B 2313/02741* (2013.01)

(58) Field of Classification Search

CPC ..... F24F 3/065; F25B 13/00; F25B 25/05; F25B 2313/0231; F25B 2313/02732; F25B 2313/02741

USPC ..... 62/185, 113, 196.1, 324.2, 324.6, 159, 62/160

See application file for complete search history.

(56) References Cited

U.S. PATENT DOCUMENTS

2010/0139312 A1* 6/2010 Takegami et al. ..... 62/498

FOREIGN PATENT DOCUMENTS

| | | | |
|---|---|---|---|
| JP | 2-118372 A | | 5/1990 |
| JP | 03017475 | * | 1/1991 |
| JP | 2003-343936 A | | 12/2003 |
| JP | 2006-258390 A | | 9/2006 |

OTHER PUBLICATIONS

International Search Report (PCT/ISA/210) issued on Dec. 22, 2009, by Japanese Patent Office as the International Searching Authority for International Application No. PCT/JP2009/066377.

* cited by examiner

*Primary Examiner* — Marc Norman
(74) *Attorney, Agent, or Firm* — Buchanan Ingersoll & Rooney PC

(57) ABSTRACT

An air-conditioning apparatus includes a heat medium side device with plural pumps for circulating the heat medium related to the heating or the cooling of plural intermediate heat exchangers. Plural use side heat exchangers exchange heat between the heat medium and air. Plural flow path switching valves switch the flow path for supplying the heat medium related to a selected system among the heating media circulating in plural systems to each use side heat exchanger. A relay unit side control device controls the flow path switching valves so as to circulate the heat medium between the use side heat exchanger causing the heat medium to absorb the heat and the use side heat exchanger causing the heat medium to emit the preferentially set heat, when it is determined that it is impossible to perform the heating or the cooling of the heat medium by the intermediate heat exchanger.

4 Claims, 6 Drawing Sheets

AIR-CONDITIONING APPARATUS

TECHNICAL FIELD

The present invention relates to an air-conditioning apparatus that can perform cooling or heating, for example, for each indoor unit, and is installed in a building or the like.

BACKGROUND ART

In the related art, an air-conditioning apparatus exists which transports a cooling energy or a heating energy to an air conditioning target area such as an indoor area by circulating refrigerant between outdoor unit as heat source unit disposed in an outdoor area and indoor unit disposed in an indoor area, thereby executing a cooling operation or a heating operation. For example, for structural use in buildings or the like, there is a building multi-air conditioner in which one or plural outdoor unit and plural indoor unit are connected to each other via pipes to circulate the refrigerant (for example, see Patent Literature 1). As the refrigerant used in the air-conditioning apparatus, for example, an HFC-based refrigerant is widely used. Furthermore, in recent years, a natural refrigerant such as carbon dioxide ($CO_2$) has also been used.

Furthermore, an air-conditioning apparatus of another configuration represented by a chiller system also exists. In the air-conditioning apparatus, the cooling energy or the heating energy is created in the heat source unit disposed in an outdoor area, the heating energy or the cooling energy is transmitted to water, anti-freezing fluid or the like by a heat exchanger disposed in the outdoor unit and is transported to a fan coil unit, a panel heater or the like which is the indoor unit disposed in the air conditioning target area, thereby executing the cooling operation or the heating operation (for example, see Patent Literature 2). In addition, there is also an air-conditioning apparatus in which four water pipes are connected to heat source unit called a waste heat recovery type chiller to supply the cooling energy and the heating energy.

CITATION LIST

Patent Literature

[Patent Literature 1] JP-A-2-118372 (page 3, FIG. 1)
[Patent Literature 2] JP-A-2003-343936 (page 5, FIG. 1)

SUMMARY OF INVENTION

Technical Problem

Herein, in the building, for example, in some cases, there is a space (hereinafter, typically referred to as a computer room) that requires the cooling energy supply regardless of the season or the like, such as a computer room. In the common air-conditioning apparatus, when a compressor is stopped and the circulation of the refrigerant is stopped, it becomes impossible to supply the cooling energy to the computer room.

Meanwhile, in the chiller system such as that of Patent Literature 2, even when the compressor is stopped, air in the computer room can be cooled by circulating water. A medium in the pipes related to the supply of the cooling energy supplies the cooling energy to the computer room and absorbs the amount of heat of air of the computer room, but the heat emission is limited due to a difference between water pipes of the cooling energy supply and the heating energy supply or the like, whereby it is impossible to perform the cooling energy supply over a long time.

The present invention is made so as to solve the problem mentioned above, and an object thereof is to obtain an air-conditioning apparatus or the like that is capable of consecutively supplying a required amount of heat to the indoor unit requiring the amount of heat over a long time as effectively as possible.

Solution to Problem

An air-conditioning apparatus according to the present invention includes: a heat medium circulating device that connects a plurality of heat medium feeding devices circulating a heat medium related to heating or cooling by heating and cooling means and a plurality of use side heat exchangers exchanging heat between air which is heat exchange target and the heat medium by piping to constitute a heat medium circulation circuit; and control device that selects a use side heat exchanger absorbing heat into the heat medium and a use side heat exchanger emitting heat from the heat medium and circulates the heat medium so as to preferentially exchange heat in a predetermined use side heat exchanger, when determining that the heating and cooling means cannot perform heating or cooling using the heat medium.

Advantageous Effects of Invention

According to the present invention, a use side heat exchanger (the indoor unit) prioritizing the operation is set in advance, when it is impossible to perform the heating or the cooling of the heat medium by the heating and cooling means, the control device circulates the heat medium between the use side heat exchanger absorbing the selected heat medium and the use side heat exchanger emitting the heat medium, thereby preferentially exchanging heat in a predetermined use side heat exchanger. Thus, it is possible to limit the temperature of air in the air conditioning target space for as long a time as possible. At this time, by the heat exchange in a predetermined use side heat exchanger, the treatment of the amount of heat absorbed by the heat medium from air or the complement of the emitted amount of heat in the air conditioning space is performed by the heat exchange in another selected use side heat exchanger. Thus, the temperature of air can be further maintained for a long time.

DESCRIPTION OF EMBODIMENTS

Embodiment 1

Figure 1:
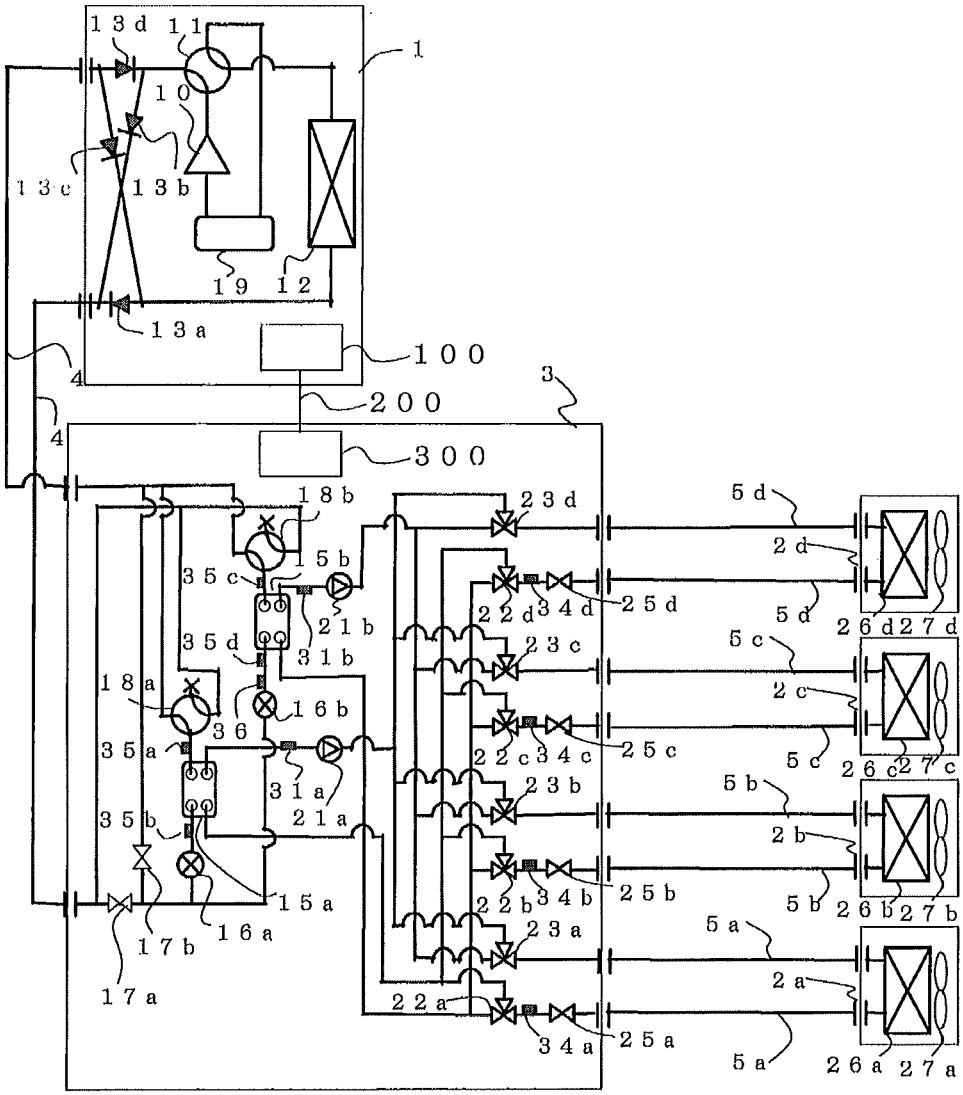
FIG. 1 is a diagram that shows a configuration of an air-conditioning apparatus according to the embodiment of the present invention.

FIG. 1 is a diagram that shows a configuration of an air-conditioning apparatus according to the embodiment 1. The air-conditioning apparatus of FIG. 1 has outdoor unit 1 as a heat source device, and one or plural indoor unit 2 for performing the air conditioning of an air conditioning target space. Furthermore, the air-conditioning apparatus has a relay unit 3 that is a relay device, which exchanges heat between the refrigerant and a medium transporting heat different from the refrigerant and performs the relay of the heat transfer, as a separate unit. A refrigerant pipe 4 is connected between the outdoor unit 1 and the relay unit 3 so as to circulate the refrigerant such as a near-azeotropic mixing refrigerant such as, for example, R-410A and R-404A and to perform the transportation of the amount of heat. Meanwhile, a water pipe 5 is connected between the relay unit 3 and the indoor unit 2 so as to circulate a medium (a heat medium) such as water and an antifreeze fluid with a non-volatile or low-volatile preservative added thereto in a water and air conditioning temperature area and perform the transportation of the amount of heat. Herein, it is described that the heat medium circulating in the water pipe 5 is water.

Herein, in this embodiment, the outdoor unit 1 is provided in a space outside a structure such as a building. Furthermore, the indoor unit 2 is provided at a position where air of an indoor space which is air conditioning space such as a living room can be heated or cooled in the building. The relay unit 3 is provided, for example, in a space where no people enter or exit or only a few people enter and exit in the building, and is configured so that the refrigerant does not adversely affect (for example, cause discomfort or the like) the people due to an occurrence of the refrigerant leakage or the like.

Furthermore, the portion between the outdoor unit 1 and the relay unit 3 of this embodiment is configured so that the portion may be connected using two refrigerant pipes 4. Furthermore, portions between the relay unit 3 and each piece of indoor unit 2 are also connected to each other in parallel using two water pipes 5, respectively. Herein, since the relay unit 3 and each piece of indoor unit 2 are basically installed in the building, the length of a circulation path of water can be shorter than the chiller system of the related art, whereby energy consumption for circulating water can be suppressed.

The air-conditioning apparatus of FIG. 1 has a refrigeration cycle device in which a compressor 10, a refrigerant flow path switching device 11, a heat source side heat exchanger 12, check valves 13*a*, 13*b*, 13*c* and 13*d*, intermediate heat exchangers 15*a* and 15*b*, opening and closing valves 17*a* and 17*b*, refrigerant flow path switching valves 18*a* and 18*b*, and an accumulator 19 are connected by piping to constitute a refrigeration cycle (a refrigerant circulation circuit, a primary side circuit).

The compressor 10 pressurizes and discharges (sends) the suctioned refrigerant. Furthermore, a four-way valve 11, which is a refrigerant flow path switching device, performs the switching of a side corresponding to an operation form (mode) related to the heating and the cooling, so that the path of the refrigerant is switched based on the instruction of an outdoor unit side control device 100. In this embodiment, the refrigerant path is switched depending on the time of a cooling only operation (an operation when all the operated indoor unit 2 perform the cooling (also including the dehumidification, hereinafter the same)) and a cooling main operation (when the main operation is cooling in a case where indoor unit 2 performing the cooling and indoor unit 2 performing the heating concurrently exist), and the time of a heating main operation (when the main operation is heating in a case where indoor unit 2 performing the cooling and indoor unit 2 performing the heating are concurrently present) and a heating only operation (an operation when all the operated indoor unit 2 perform the heating).

The heat source side heat exchanger 12 has, for example, a heat transfer tube through which the refrigerant passes, and a fin (not shown) for increasing a heat transfer area between the refrigerant flowing in the heat transfer tube and outside air, and exchanges heat between the refrigerant and air (the outside air). For example, during a heating only operation, the heat source side heat exchanger 12 functions as an evaporator at the time of the heating main operation, evaporates the refrigerant and converts the refrigerant into gas (vapor). Meanwhile, during cooling only operation, the heat source side heat exchanger 12 functions as a condenser or a gas cooler (hereinafter, referred to as a condenser) at the time of the cooling main operation. In some cases, a two-phase mixed (gas-liquid two-phase refrigerant) state of liquid and gas may be obtained without complete gasification and liquefaction.

The check valves 13*a*, 13*b*, 13*c* and 13*d* prevent the reverse flow of the refrigerant, arrange the flow of the refrigerant, and make the circulation path in the inflow and the outflow of the refrigerant to the outdoor unit 1 constant. The intermediate heat exchangers 15*a* and 15*b* have heat transfer tubes through which the refrigerant passes, and heat transfer tubes through which the heat refrigerant passes, and exchange heat between the medium by the refrigerant and water. In this embodiment, the intermediate heat exchanger 15*a* functions as the evaporator in the cooling only operation, the cooling main operation, and the heating main operation and causes the refrigerant to absorb the heat to cool water (hereinafter, this water is called cold water). The intermediate heat exchanger 15*b* functions as a condenser or a gas cooler in the cooling main operation and the heating main operation, and causes the refrigerant to emit the heat to heat water (hereinafter, this water is called warm water). Furthermore, for example, expansion valves 16*a* and 16*b* such as an electronic type expansion valve decompress the refrigerant by adjusting the flow rate of the refrigerant. The opening and closing valves 17*a* and 17*b* and the refrigerant flow path switching valves 18*a* and 18*b* are operated based on the instruction of a relay unit side control device 300, and change the path of the refrigerant in the relay unit 3. The accumulator 19 has a function of storing the excessive refrigerant in the refrigerating cycle or preventing a large quantity of refrigerant liquid from returning to the compressor 10 and damaging the compressor 10.

Furthermore, in FIG. 1, a water side device is included in which the intermediate heat exchangers 15*a* and 15*b*, water feeding devices 21*a* and 21*b*, flow path switching valves 22*a*, 22*b*, 22*c*, 22*d*, 23*a*, 23*b*, 23*c*, and 23*d*, flow rate adjusting valves 25*a*, 25*b*, 25*c*, and 25*d*, and use side heat exchangers 26*a*, 26*b*, 26*c*, and 26*d* are connected by the pipes to constitute a water circulation circuit (a secondary side circuit, a heat medium circulation circuit).

Pumps 21*a* and 21*b* as the water feeding device pressurize water for the circulation. Herein, in regard to the pumps 21*a* and 21*b*, by changing the revolution of a built-in motor (not shown) within a fixed range, the flow rate (the discharging flow rate) of feeding water can be changed. Furthermore, the pump 21*a* circulates the cold water by the intermediate heat exchanger 15*a*, and the pump 21*b* circulates the warm water by the intermediate heat exchanger 15*b*. Thus, the pump 21*a* is a cold pump 21*a*, and the pump 21*b* is a hot pump 21*b*.

The use side heat exchangers 26*a*, 26*b*, 26*c*, and 26*d* exchange heat between water and air supplied to the air conditioning target space in the indoor unit 2*a*, 2*b*, 2*c*, and 2*d*, respectively, and heat or cool air to be transported to the air conditioning target space in the air conditioning target space. Furthermore, for example, the flow path switching valves 22*a*, 22*b*, 22*c*, and 22*d* as three-way switching valves or the like perform the switching of the flow path at inlet sides (water outflow sides) of the use side heat exchangers 26*a*, 26*b*, 26*c*, and 26*d*, respectively. Furthermore, the flow path switching valves 23*a*, 23*b*, 23*c*, and 23*d* also perform the switching of the flow path at the outlet sides (water inflow sides) of the use side heat exchangers 26*a*, 26*b*, 26*c*, and 26*d*. Herein, such switching devices perform the switching for causing any one of the warm water and the cold water to pass through the use side heat exchangers 26*a*, 26*b*, 26*c*, and 26*d* so that the warm and the cold water are basically not mixed with each other, but the switching can suitably be changed depending on the circulation path. Furthermore, in this embodiment, the switching directions of the flow path switching valves 22*a*, 22*b*, 22*c*, 22*d*, 23*a*, 23*b*, 23*c*, and 23*d* are not necessarily fixed by the cooling (the heat absorption from the indoor air) and the heating (the heat emission to the indoor air) in the indoor unit 2*a*, 2*b*, 2*c*, and 2*d*. The flow rate adjusting valves 25*a*, 25*b*, 25*c*, and 25*d* adjust the flow rate of water flowing in the use side heat exchangers 26*a*, 26*b*, 26*c*, and 26*d*, for example, based on the instruction from the relay unit side control device 300 which received the instruction from the respective pieces of indoor unit 2*a*, 2*b*, 2*c*, and 2*d*, respectively. Furthermore, in the present embodiment, in order to promote the heat exchange, use side fans 27*a*, 27*b*, 27*c*, and 27*d* for feeding air subjected to heat exchange to the use side heat exchangers 26*a*, 26*b*, 26*c*, and 26*d* are included.

First temperature sensors 31*a* and 31*b* are temperature sensors that detect the temperature of water at the outlet sides (the water outflow sides) of water of the intermediate heat exchangers 15*a* and 15*b*, respectively. Furthermore, second temperature sensors 34*a*, 34*b*, 34*c*, and 34*d* are temperature sensors that detect the temperature of water at the outlet sides (the outflow sides) of the use side heat exchangers 26*a*, 26*b*, 26*c*, and 26*d*, respectively. Third temperature sensors 35*a*, 35*b*, 35*c*, and 35*d* are temperature sensors that detect the temperature of the refrigerant at the refrigerant inlet sides (the refrigerant inflow sides) and the refrigerant outlet sides (the refrigerant outflow sides) of the intermediate heat exchangers 15*a* and 15*b*, respectively. Pressure sensor 36 detects the pressure between the intermediate heat exchanger 15*b* and the expansion valve 16*b*. From the temperature detection devices and the pressure detection device mentioned above, the temperature related to the detection and the signal related to the pressure are sent to the relay unit side control device 300. Hereinafter, for example, in regard to the same devices such as, for example, the second temperature sensors 34*a*, 34*b*, 34*c*, and 34*d*, unless specifically distinguished, for example, subscripts thereof are omitted, or those sensors are denoted by the second temperature sensors 34*a* to 34*d*. This is also true for other equipment and device.

Furthermore, in this embodiment, in the outdoor unit 1 and the relay unit 3, the outdoor unit side control device 100 and the relay unit side control device 300 are included, respectively. Moreover, the outdoor unit side control device 100 and the relay unit side control device 300 are connected to each other by a signal line 200 for performing the communication including various data. Herein, the signal line 200 may be wireless. The outdoor unit side control device 100 performs the processing for performing the control, for example, sends the signal or the like related to the instruction to each device, accommodated in, particularly, the outdoor unit 1 of the refrigeration cycle device. For this reason, for example, a memory device (not shown) is included which memorizes various data, a program or the like required for performing the processing, such as data or the like related to the detections of various detection devices (sensors) temporarily or for a long time. Furthermore, the relay unit side control device 300 performs the processing for performing the control, for example, sends the signal or the like related to the instruction to the respective pieces of equipment accommodated in the relay unit 3 such as the equipment of the heat medium circulating device. The relay unit side control device 300 also similarly has a memory device (not shown). In FIG. 1, the outdoor unit side control device 100 and the relay unit side control device 300 are provided in the inner portions of the outdoor unit 1 and the relay unit 3, respectively, but the invention is not limited thereto.

Moreover, in this embodiment, the compressor 10, the four-way valve 11, the heat source side heat exchanger 12, the check valves 13*a* to 13*d*, the accumulator 19, and the indoor side control device 100 are accommodated in the outdoor unit 1. Furthermore, the use side heat exchangers 26*a* to 26*d*, and the use side fans 27*a* to 27*d* are accommodated in the respective indoor unit 2*a* to 2*d*, respectively. Herein, in this embodiment, the indoor unit 2*a* is used in a computer room. For this reason, the indoor unit 2*a* performs only the cooling. Furthermore, the indoor unit 2*b* is an outside air intake type indoor unit that sends the air-conditioned outside air to the air conditioning target space by taking in the outside air and exchanging heat between the outside air and the use side heat exchanger 26*b*. In this embodiment, the operations of the indoor unit 2*a* and the indoor unit 2*b* are performed prior to other indoor unit 2.

In addition, in the present embodiment, among each equipment and refrigeration cycle device except for the use side heat exchangers 26*a* to 26*d* related to the heat medium circulating device, the expansion valves 16*a* and 16*b*, the opening and closing valves 17*a* and 17*b*, and the refrigerant flow path switching valves 18*a* and 18*b* are accommodated in the relay unit 3. The first temperature sensors 31*a* and 31*b*, the second temperature sensors 34*a* to 34*d*, and the third temperature sensors 35*a* to 35*d* are also accommodated in the relay unit 3.

Next, the operation of the air-conditioning apparatus of each operation mode will be described based on the flow of the refrigerant and water. In this embodiment, since the indoor unit 2*a* always performs the cooling operation, an operation is not performed in which all of the operated indoor unit 2 is heated. Herein, high pressure and low pressure in the refrigeration cycle or the like are not defined by the relationship with standard pressure, but are indicated as high pressure and low pressure as relative pressures that can be obtained by the compression of the compressor 1, the refrigerant flow rate control of the expansion valves 16*a* and 16*b* or the like. Furthermore, this is also true for high and low temperatures.

<Cooling Only Operation>

Figure 2:
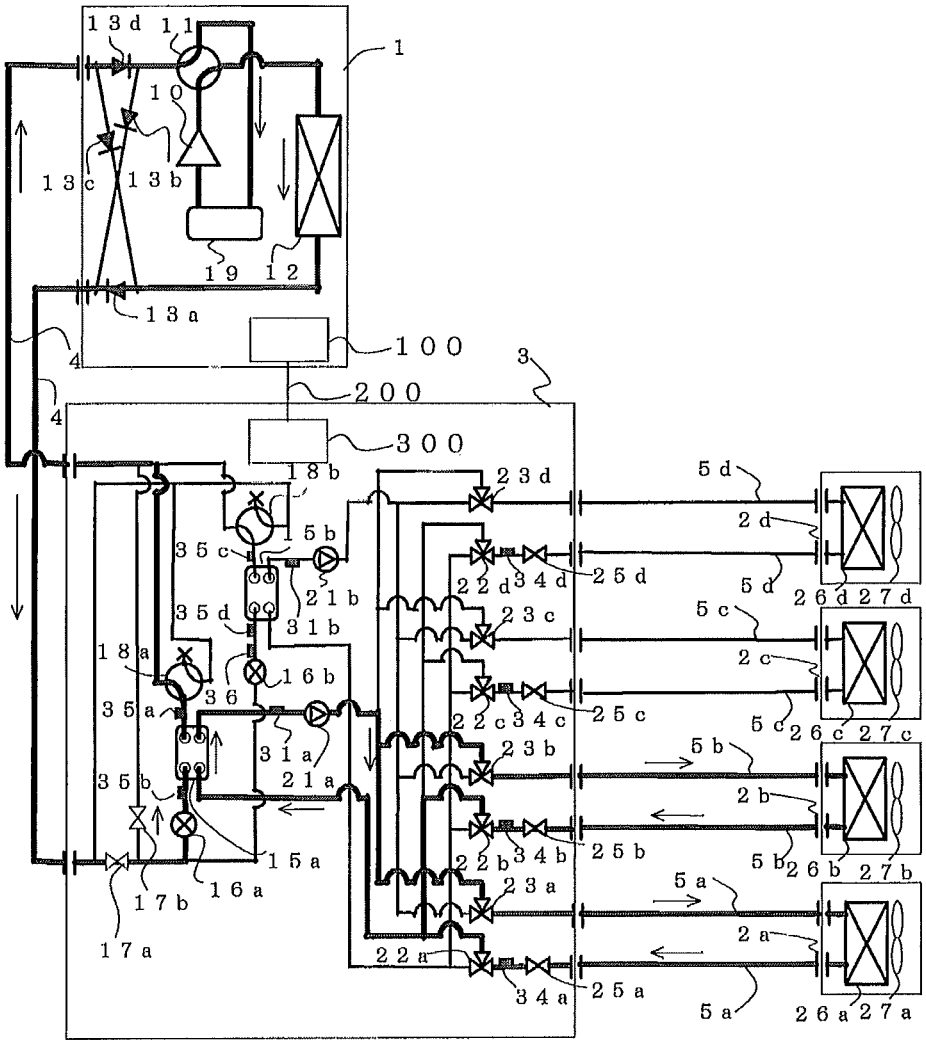
FIG. 2 is a diagram that shows flows of a refrigerant and a heat medium during cooling only operation.

FIG. 2 is a diagram that shows the respective flows of the refrigerant and water in the cooling only operation. Herein, a case will be described where the indoor unit 2*a* and 2*b* perform the cooling of the air conditioning target spaces which are the targets, respectively, and the indoor unit 2*c* and 2*d* are stopped. Firstly, the flow of the refrigerant in the refrigeration cycle will be described. Herein, the open and close value 17*a* is in an opened state, and the opening and closing valve 17*b* is in a closed state. The expansion valve 16*b* is also set so as to cause the refrigerant not to pass therethrough.

Firstly, in the outdoor unit 1, the refrigerant suctioned to the compressor 10 is compressed and is discharged as the high-pressure gas refrigerant. The refrigerant exiting the compressor 10 flows to the heat source side heat exchanger 12 functioning as the condenser via the four-way valve 11. The high-pressure gas refrigerant is condensed by the heat exchange with the outside air when passing through the inner portion of the heat source side heat exchanger 12, becomes the liquid refrigerant of high pressure, outflows, and flows in the check valve 13*a* (the refrigerant does not flow at the check valves 13*b* and 13*c* side due to the pressure of the refrigerant). Furthermore, the refrigerant flows in the relay unit 3 through the refrigerant pipe 4.

The liquid refrigerant flowing in the relay unit 3 passes through the opening and closing valve 17*a*, and the liquid refrigerant passes through the expansion valve 16*a* and flows in the intermediate heat exchanger 15*a*. Herein, the relay unit side control device 300 controls the opening of the expansion valve 16*a* based on the temperature difference (degree of superheat) related to the detection of the third temperature sensors 35*a* and 35*b*. For this reason, the expansion valve 16*a* decompresses the refrigerant by adjusting the flow rate of the refrigerant, whereby the gas and liquid two-phase refrigerant of low temperature and low pressure flows in the intermediate heat exchanger 15*a*.

Since the intermediate heat exchanger 15*a* functions as the evaporator of the refrigerant, the refrigerant passing through the intermediated heat exchanger 15*a* becomes gas refrigerant of low temperature and low pressure and flows out while cooling water subjected to heat exchange (while absorbing the heat from water). The gas refrigerant flowing out of the intermediate heat exchanger 15*a* passes through the refrigerant flow path switching valve 18*a* and flows out of the relay unit 3. Moreover, the gas refrigerant passes through the refrigerant pipe 4 and flows in the outdoor unit 1.

The refrigerant flowing in the outdoor unit 1 passes through the check valve 13*d* and is suctioned to the compressor 10 again via the four-way valve 11 and the accumulator 19.

Next, the flow of water in the water circulation circuit will be described. Herein, in FIG. 2, there is no need to cause water to pass through the use side heat exchangers 26*c* and 26*d* of the indoor unit 2*c* and 2*d* which do not need to transport the heat due to the stoppage (there is no need to cool the air conditioning target space, a thermo OFF state is included). Thus, based on the instruction from the relay unit side control device 300, the flow rate adjusting valves 25*c* and 25*d* are closed, so that water does not flow to the use side heat exchangers 26*c* and 26*d*.

The cold water cooled by the heat exchange with the refrigerant in the intermediate heat exchanger 15*a* is suctioned by the cold pump 21*a* and is sent out. The cold water discharged from the cold pump 21*a* passes through the flow path switching valves 23*a* and 23*b*. Moreover, by the flow rate adjustment of the flow rate adjusting valves 25*a* and 25*b* based on the instruction from the relay unit side control device 300, water, which obtains (supplies) the heat required for the work for cooling air of the air conditioning target space, flows in the use side heat exchangers 26*a* and 26*b*. Herein, the relay unit side control device 300 causes the flow rate adjusting valves 25*a* and 25*b* to adjust the water amount such that a temperature difference between the temperature related to the detection of the first temperature sensor 31*a* and the temperature related to the detection of the fourth temperature sensors 34*a* and 34*b* approaches the set objective value.

The cold water flows to the use side heat exchangers 26*a* and 26*b* in order to exchange heat with air of the air conditioning target space and flows out. Moreover, the cold water passes through the flow rate adjusting valves 25*a* and 25*b* and the flow path switching valves 22*a* and 22*b* and flows in the intermediate heat exchanger 15*a*. The cold water passing through the intermediate heat exchanger 15*a* is suctioned by the cold pump 21*a* again and is sent out.

<Cooling Main Operation>

Figure 3:
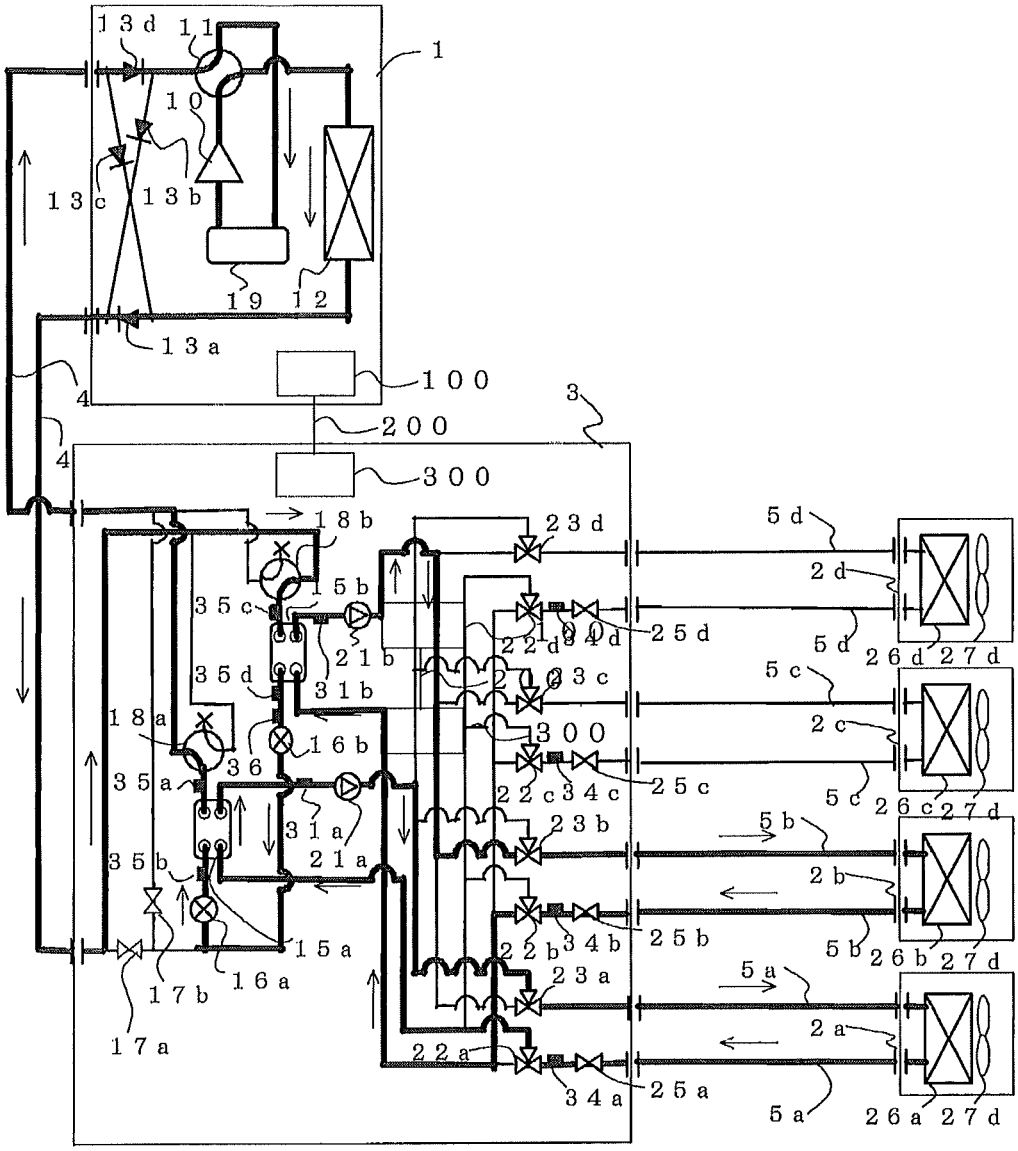
FIG. 3 is a diagram that shows flows of the refrigerant and the heat medium during cooling main operation.

FIG. 3 is a diagram that shows the flows of each of the refrigerant and water in the cooling main operation. Herein, a case will be described where the indoor unit 2*a* performs the cooling, the indoor unit 2*b* performs the heating, and the indoor unit 2*c* and 2*d* are stopped. Herein, the opening and closing valves 17*a* and 17*b* are in a closed state. Furthermore, the expansion valve 16*b* is fully opened so that the pressure loss is not generated.

Firstly, the flow of the refrigerant in the refrigeration cycle will be described. In the outdoor unit 1, the refrigerant suctioned to the compressor 10 is compressed and is discharged as the gas refrigerant of high pressure. The refrigerant exiting the condenser 10 flows to the heat source side heat exchanger 12 via the four-way valve 11. The high-pressure gas refrigerant is condensed by the heat exchange with the outside air when passing though the inner portion of the heat source side heat exchanger 12. Herein, during cooling main operation, the gas and liquid two-phase refrigerant flows out of the heat source side heat exchanger 12. The gas and liquid two-phase refrigerant flowing out of the heat source side heat exchanger 12 flows in the check valve 13*a*. Furthermore, the refrigerant flows in the relay unit 3 through the refrigerant pipe 4.

The refrigerant flowing in the relay unit 3 passes through the refrigerant flow path switching valve 18*b*, and flows in the intermediate heat exchanger 15*b*. The refrigerant flowing in the intermediate heat exchanger 15*b* becomes the liquid refrigerant, flows out, while heating water subjected to heat exchange by condensation, and passes through the expansion valve 16*b*. The liquid refrigerant becomes gas and liquid two-phase refrigerant of low temperature and low pressure by passing through the expansion valve 16*b*.

Moreover, the gas and liquid two-phase refrigerant passes through the fully opened expansion valve 16*a*, and flows in the intermediate heat exchanger 15*a*. The refrigerant flowing in the intermediate heat exchanger 15*a* becomes gas refrigerant of low temperature and low pressure and flows out while cooling water subjected to heat exchange by evaporation. The gas refrigerant flowing out of the intermediate heat exchanger 15*a* passes through the refrigerant flow path switching valve 18*a* and flows out of the relay unit 3. Moreover, the gas refrigerant passes through the refrigeration pipe 4 and flows in the outdoor unit 1.

Herein, the relay unit side control device 300 controls the opening of the expansion valve 16*a* so that the degree of superheat (the superheat), which is a difference between the temperature related to the detection of the third temperature sensor 35*a* and the temperature related to the detection of the third temperature sensor 35*b*, is constant. Furthermore, the relay unit side control device 300 may control the opening of the expansion valve 16*b* so that a degree of subcooling (the subcooling), which is a difference between a value obtained by converting the pressure related to the detection of the pressure sensor 36 to a saturation temperature and the temperature related to the detection of the third temperature sensor 35*d*, is constant. Furthermore, the expansion valve 16*b* is fully opened, and the control of the degree of superheat and the degree of subcooling may be performed by the expansion valve 16*a* instead of the expansion valve 16*b*.

The refrigerant flowing in the outdoor unit 1 passes through the check valve 13*d*, and is suctioned to the compressor 10 again via the four-way valve 11 and the accumulator 19.

Next, the flow of water in the water circulation circuit will be described. Herein, in FIG. 3, there is no need to cause water to pass through the use side heat exchangers 26*c* and 26*d* of the indoor unit 2*c* and 2*d* to which the heat load is not applied by the stoppage (there is no need to cool and heat the air conditioning target space, including a thermo OFF state). Thus, based on the instruction from the relay unit side control device 300, the flow rate adjusting valves 25*c* and 25*d* are closed, so that water does not flow to the use side heat exchangers 26*c* and 26*d*.

The cold water cooled by the heat exchange with the refrigerant in the intermediate heat exchanger 15*a* is suctioned by the cold pump 21*a* and is sent out. Furthermore, the warm water heated by the heat exchange with the refrigerant in the intermediate heat exchanger 15*b* is suctioned by the hot pump 21*b* and is sent out.

The cold water discharged from the cold pump 21*a* passes through the flow path switching valve 23*a*. Furthermore, the warm water discharged from the hot pump 21*b* passes through the flow path switching valve 23*b*. In this manner, the flow path switching valve 23*b* causes the warm water to pass therethrough and blocks the cold water. Furthermore, the flow path switching valve 23*a* causes the cold water to pass therethrough and blocks the warm water. For this reason, the flow paths, in which the cold water and the warm water flow during circulation, are divided and separated from each other, and are not mixed with each other.

Moreover, by the flow rate adjustment of the flow rate adjusting valves 25*a* and 25*b* based on the instruction from the relay unit side control device 300, water, which obtains (supplies) the heat required for the work for cooling and heating air of the air conditioning target space, flows in the use side heat exchangers 26*a* and 26*b*. Herein, in relation to the cold water, the relay unit side control device 300 causes the flow rate adjusting valve 25*a* to adjust the water amount such that a temperature difference between the temperature related to the detection of the first temperature sensor 31*a* and the temperature related to the detection of the fourth temperature sensor 34*a* approaches the set objective value. Meanwhile, in relation to the warm water, the relay unit side control device 300 causes the flow rate adjusting valve 25*b* to adjust the water amount such that a temperature difference between the temperature related to the detection of the first temperature sensor 31*b* and the temperature related to the detection of the fourth temperature sensor 34*b* approaches the set objective value.

Water flowing in the use side heat exchangers 26*a* and 26*b* exchanges heat with air of the air conditioning target space and flows out. Moreover, water passes through the flow rate adjusting valves 25*a* and 25*b* and the flow path switching valves 22*a* and 22*b* and flows in the intermediate heat exchangers 15*a* and 15*b*. Water cooled in the intermediate heat exchanger 15*a* is suctioned by the cold pump 21*a* again and is sent out. Similarly, water heated in the intermediate heat exchanger 15*b* is suctioned by the cold pump 21*b* again and is sent out.

<Heating Main Operation>

Figure 4:
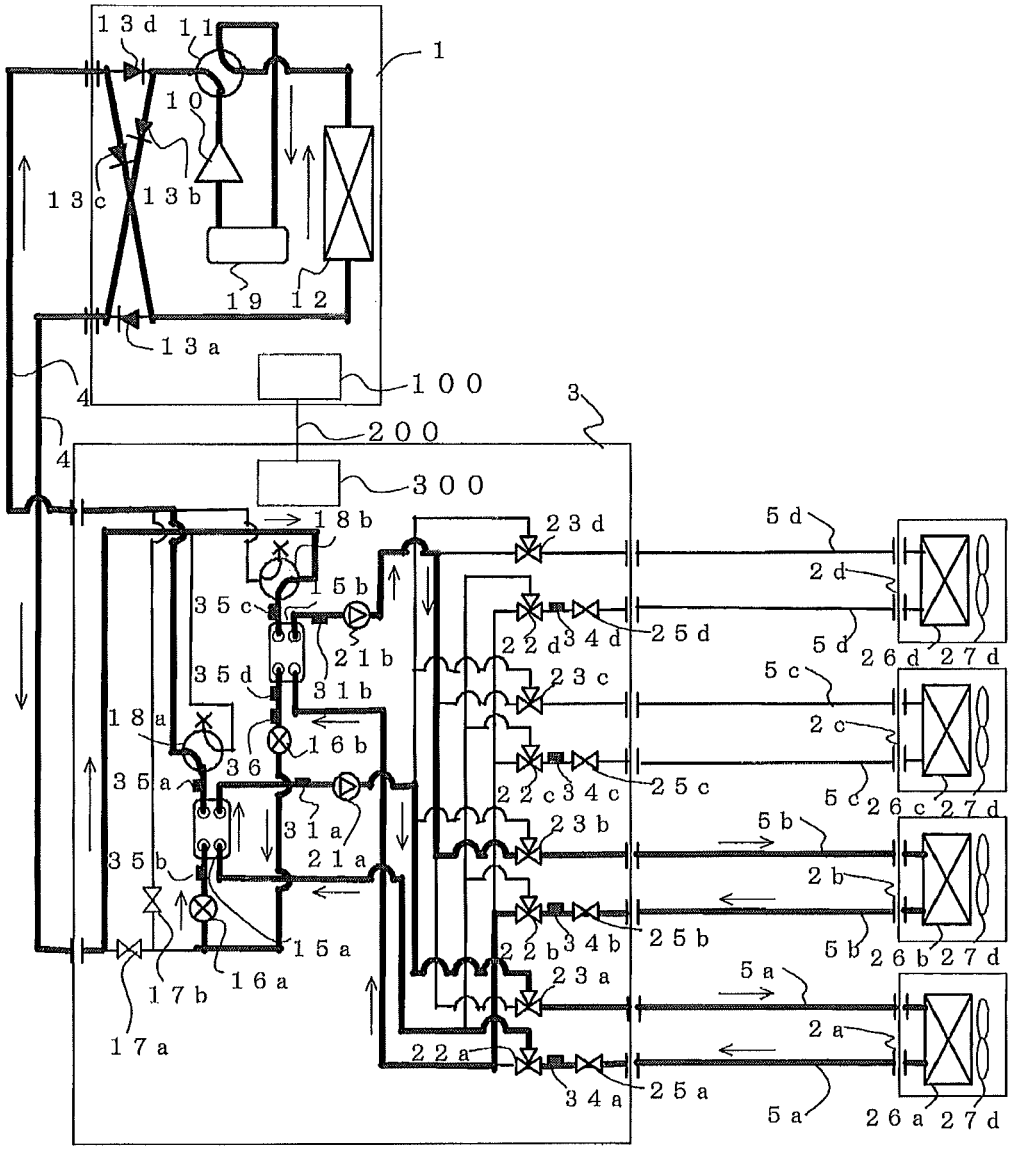
FIG. 4 is a diagram that shows flows of the refrigerant and the heat medium during heating main operation.

FIG. 4 is a diagram that shows the flows of each of the refrigerant and water in the heating main operation. Herein, a case will be described where the indoor unit 2*a* performs the cooling, the indoor unit 2*b* performs the heating, and the indoor unit 2*c* and 2*d* are stopped. Herein, the opening and closing valves 17*a* and 17*b* are in a closed state.

Firstly, the flow of the refrigerant in the refrigeration cycle will be described. In the outdoor unit 1, the refrigerant suctioned to the compressor 10 is compressed and is discharged as the high-pressure gas refrigerant. The refrigerant exiting the compressor 10 flows in the four-way valve 11 and the check valve 13*b*. Furthermore, the refrigerant flows in the relay unit 3 through the refrigerant pipe 4.

The refrigerant flowing in the relay unit 3 passes through the refrigerant flow path switching valve 18*b*, and flows in the intermediate heat exchanger 15*b*. The refrigerant flowing in the intermediate heat exchanger 15*b* becomes the liquid refrigerant, flows out, while heating water subjected to heat exchange by the condensation, and passes through the expansion valve 16*b*. The liquid refrigerant becomes the gas and liquid two-phase refrigerant of low temperature and low pressure by passing through the expansion valve 16*b*.

Moreover, the gas and liquid two-phase refrigerant passes through the fully opened expansion valve 16*a*, and flows in the intermediate heat exchanger 15*a*. The refrigerant flowing in the intermediate heat exchanger 15*a* becomes the gas refrigerant of low temperature and low pressure and flows out while cooling water subjected to heat exchange by evaporation. The gas refrigerant flowing out of the intermediate heat exchanger 15*a* passes through the refrigerant flow path switching valve 18*a* and flows out of the relay unit 3. Moreover, the gas refrigerant passes through the refrigeration pipe 4 and flows in the outdoor unit 1.

Herein, the relay unit side control device 300 controls the opening of the expansion valve 16*b* so that a degree of subcooling (the subcooling), which is a difference between a value obtained by converting the pressure related to the detection of the pressure sensor 36 to a saturation temperature and the temperature related to the detection of the third temperature sensor 35*b*, is constant. For example, the expansion valve 16*b* is fully opened, and the degree of subcooling may be controlled by the expansion valve 16*a* instead of the expansion valve 16*b*.

The refrigerant flowing in the heat source unit 1 flows to the heat source side heat exchanger 12 functioning as an evaporator via the check valve 13*c*. The gas and liquid two-phase refrigerant of low temperature and low pressure is evaporated by the heat exchange with the outside air upon passing through the inner portion of the heat source side heat exchanger 12, and becomes the gas refrigerant of low temperature and low pressure. The refrigerant flowing out of the heat source side heat exchanger 12 is suctioned to the compressor 10 again via the four-way valve 11 and the accumulator 19.

Meanwhile, in the heating main operation, the flow of water in the water circulation circuit is identical to the flow of water in the cooling main operation of FIG. 3 mentioned above.

In this manner, the air-conditioning apparatus of this embodiment can concurrently heat water of the water circulation circuit in the intermediate heat exchanger 15*a* by the switching of the path of the refrigerant in the relay unit 3 or the like, and cool water of the water circulation circuit in the intermediate heat exchanger 15*b*. For this reason, there is no need to supply the gas refrigerant and the liquid refrigerant from the outdoor unit 1 side to the relay unit 3 by separate pipes, respectively. Thus, it is possible to configure a refrigeration cycle in which two refrigerant pipes 4 are connected between the outdoor unit 1 and the relay unit 3, the heating and the cooling are mixed with each other in the outdoor unit 2, and the operations thereof can simultaneously be performed.

Furthermore, at the relay unit 3 side, the flow path switching valves 22*a* to 22*d* and 23*a* to 23*d* and the flow rate adjusting valves 25*a* to 25*d* are switched over and perform the flow rate adjustment. For this reason, at the relay unit 3 side, the necessary one of the warm water or the cold water is supplied or not circulated to the use side heat exchangers 26*a* to 26*d* of the respective indoor unit 2*a* to 2*d*. Thus, two water pipes 5 can also be connected between the relay unit 3 and the indoor unit 2*a* to 2*d*.

Next, an emergency operation will be described which is performed, for example, when the compressor 10 is stopped for some reason. Herein, the emergency operation is an operation for permitting the temperature of the computer room to be maintained over a time which is made to be as long as possible when the circulation of the refrigerant in the refrigeration cycle is stopped due to the stopping of the compressor 10 or the like.

When the circulation of the refrigerant is stopped in the refrigeration cycle, for example, in the intermediate heat exchanger 15*a*, it becomes impossible to cool the cold water. Thus, in this embodiment, an order of priority is set in the use side heat exchanger 15 (the indoor unit 2) in advance. Moreover, the cold water of low temperature, which is cooled until the circulation is stopped, is preferentially supplied to the indoor unit 2*a* for the computer room, so that the temperature of the computer room is maintained. Moreover, the cold water, the temperature of which is increased by the heat exchange of the use side heat exchanger 26*a* of the indoor unit 2*a*, is sent to the use side heat exchanger 26*b* of the indoor unit 2*b* that is an outside air intake type indoor unit. Moreover, the heat absorbed from air of the computer room by the cold water through the heat exchange is discharged to the outside air having the temperature lower than that of the cold water (particularly, in the winter), and the cold water is cooled and is used again in the cooling of air of the computer room.

During normal operation, when the outside air is taken in the outside air intake type indoor unit, the cooling and the heating are performed while being switched so that the temperature (a blowing temperature) of the outside air subjected to the heat exchange in the use side heat exchanger 26 is a predetermined temperature. Furthermore, when the outside air is not taken in, for example, an assist operation is used which increases the capacity of the indoor unit, for example, during a heating overload small capacity and cooling low temperature small capacity operation, thereby ensuring the stability of the operation.

For this reason, in this embodiment, when the indoor unit 2*b* does not perform the cooling, the flow path switching valves 22*b* and 23*b* are switched to perform the cooling. Moreover, a circulation path is formed which circulates the cold water between the cold pump 21*a*, the use side heat exchanger 26*a*, and the use side heat exchanger 26*b*. Moreover, by the heat exchange with the outside air in the use side heat exchanger 26*b* of the indoor unit 2*b*, the cold water heated by the heat absorption from air of the computer room in the use side heat exchanger 26*a* is cooled and is sent to the use side heat exchanger 26*a* again. In other words, in the flow of water of the cooling operation, the use side heat exchanger 26*b* of the indoor unit 2*b* heats (heating) and takes the outside air by the heat exchange.

Herein, an emergency operation is described, but, in some cases, the present invention can also be applied to a non-emergency operation. In the use side heat exchanger 26*b* of the indoor unit 2*b*, by discharging the amount of heat of the cold water to the outside air, in the intermediate heat exchanger 15*a*, the amount of heat related to the heat exchange of the refrigerant and the cold water can be reduced, and energy saving can be promoted.

As mentioned above, according to the air conditioning device of the embodiment 1, for example, in the same manner as the indoor unit 2*a* for the computer room performing the constant cooling, the indoor unit 2 which is preferentially operated during emergency operation is set in advance and for example, when it is determined that the compressor 10 is stopped and it becomes impossible to cool the cold water in the intermediate heat exchanger 15*a*, the emergency operation is started, and the cold water already cooled in the intermediate heat exchanger 15*a* is preferentially supplied to the indoor unit 2*a*. Thus, the air temperature of the computer room can be maintained without being raised. Moreover, at this time, the amount of heat related to the heat adsorption from air of the computer room is emitted by other indoor unit 2, the temperature thereof is lowered and the air is supplied to the indoor unit 2*a* again. Thus, the temperature of air of the computer room can be maintained for a long time. Particularly, in this embodiment, since the outside air intake type indoor unit 2*b* is converted to the cooling, and the heat from air of the computer room is discharged to the outside air by the use side heat exchanger 26*b* in the use side heat exchanger 26*a*, the present invention is particularly effective in the case of low temperature outside air such as in winter.

Moreover, by providing the relay unit 3, since the hot pump 21*b* and the cold pump 21*a* are closer to the position of the indoor unit 2 than the common chiller system, the circulation path length in the water circulation circuit can be reduced. Furthermore, by reducing the height difference between the relay unit 3 and the indoor unit 2 related to the vertical direction, the effect of gravity can be reduced. For this reason, it is possible to increase the transport ability of water becoming the heat medium. Furthermore, energy related to the transportation can be suppressed and energy saving can be promoted. In addition, since the water pipe 5 between the relay unit 3 and the indoor unit 2 is a two pipe type, plumbing and construction can easily be performed.

Embodiment 2

In the aforementioned embodiment, a sequence is described in which the cold water is circulated between the indoor unit 2*a* for the computer room and the outside air intake type indoor unit 2*b* in the emergency operation. In this embodiment, an emergency operation will be described which is performed so as to include another indoor unit 2 performing the heating and the cooling.

Figure 5:
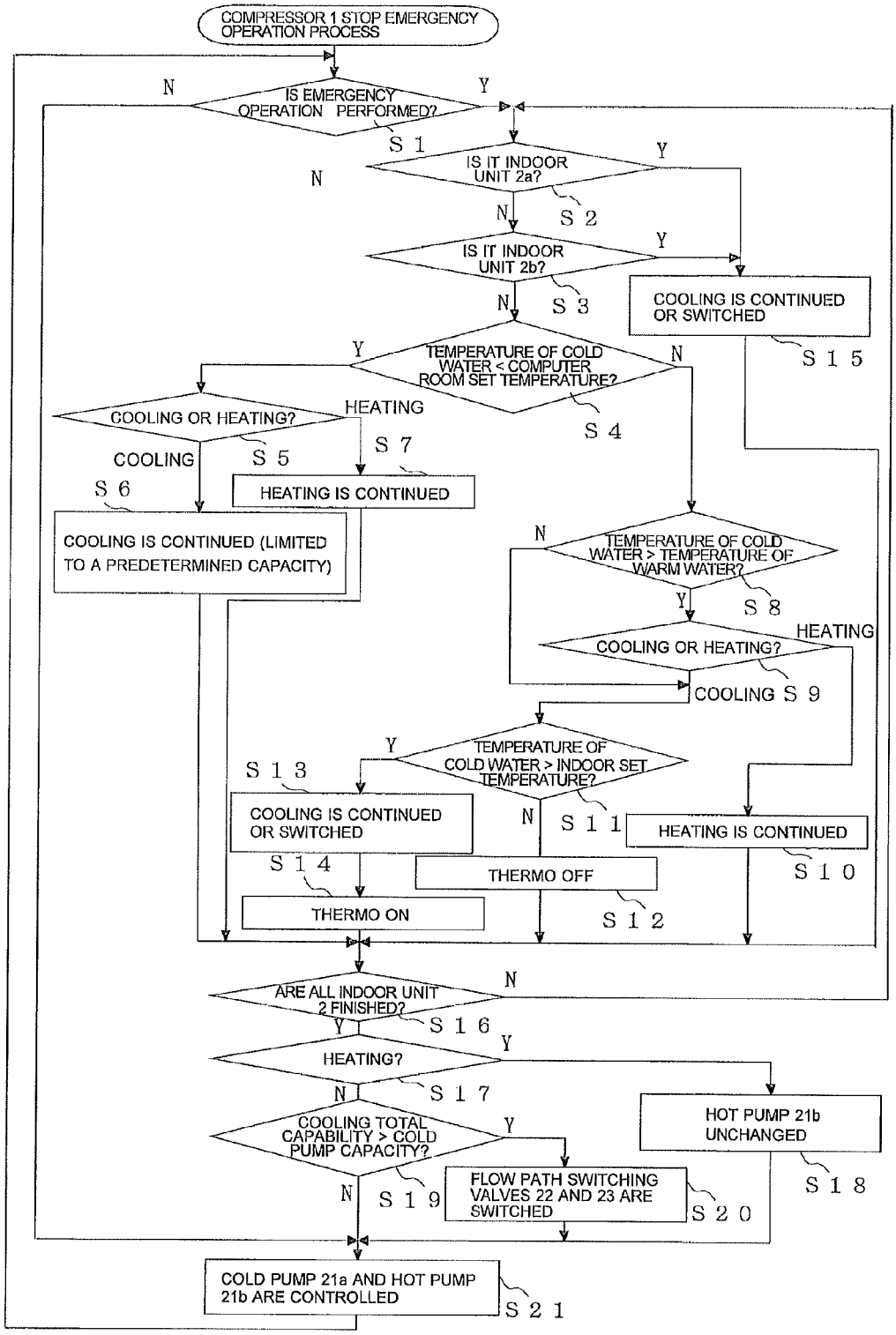
FIG. 5 is a diagram that shows a flowchart of the treatment related to an emergency operation.

FIG. 5 is a diagram that shows a flowchart of a process related to the emergency operation of the relay unit side control device 300 according to the embodiment 2 of the present invention. An operation of the air-conditioning apparatus in this embodiment will be described based on FIG. 5.

The relay unit side control device 300 determines whether or not the emergency operation is performed based on the signal or the like from the outdoor unit side control device 100 (S1). When determining that there is no need to perform the emergency operation, the discharging flow rate of the hot pump 21*b* and the cold pump 21*a* is controlled (S40).

When determining that the emergency operation is performed, an operation such as a continued operation in each piece of indoor unit performing the heating or the cooling is determined. Firstly, it is determined whether or not any of the indoor unit 2 is the indoor unit 2*a* for the computer room (S2). In the case of the indoor unit 2*a*, the cooling is continued (S15). In the case of the non-indoor unit 2*a* for the computer room, next, it is determined whether or not the indoor unit is the outside air intake type indoor unit 2*b* (S3). In the case of the indoor unit 2*b*, when the cooling is performed, the cooling is continued, and when the heating is performed, the heating is switched to the cooling to perform the cooling (S15).

When it is determined that the indoor unit is neither the indoor unit 2*a* nor the indoor unit 2*b* by S2 and S3, next, it is determined whether the temperature of the cold water is lower than the temperature (the set temperature of the computer room) set in the indoor unit 2*a* (the computer room) (S4). Herein, the temperature sensor for detecting the temperature of the cold water is not particularly limited. For example, the temperature can be determined by the temperature related to the detection of any one of the first temperature sensor 31*b* and the second temperature sensor 34*a* or plural temperature sensors.

When determining that the temperature of the cold water is lower than the set temperature of the computer room, it is determined whether the indoor unit 2 of the determination target performs the cooling or the heating (S5). When performing the cooling, the heating cooling is continued (S6). As a result, the cold water is mixed with the cold water returned from another indoor unit 2 so that the temperature of the cold water is homogenized. For example, even when being operated, the flow rate adjusting valve 25 has the opening smaller than the case of the common operation, the cooling ability is suppressed, and the cooling of the computer room is maintained as much as possible. Furthermore, when performing the heating, the heating is continued (S7), the amount of heat included in the warm water is discharged to the air conditioning target space, and the warm water is cooled.

Meanwhile, in S4, when determining that the temperature of the cold water is not lower than the set temperature of the computer room (the temperature of the cold water is equal to or higher than the set temperature of the computer room), it is determined whether or not the temperature of the cold water is higher than the temperature of the warm water (S8). When determining that the temperature of the cold water is not higher than the temperature of the warm water (the temperature of the cold water is equal to or lower than the temperature of the warm water), it is determined whether the indoor unit 2 of the determination target performs the cooling or the heating (S9). When performing the heating, the heating is continued (S10). When performing the cooling, it is determined whether or not the temperature of the cold water is higher than the temperature (the indoor temperature) of air subjected to air conditioning (S11). Herein, the temperature of air is detected by temperature sensors (not shown) or the like provided in each piece of indoor unit 2.

When determining that the temperature of the cold water is not higher than the indoor temperature (the temperature of the cold water is equal to or lower than the indoor temperature), the cold water is caused not to flow to the use side heat exchanger 26, for example, by the flow rate adjusting valve 25, and the use side fan 27 or the like is stopped (thermo OFF) (S12). Meanwhile, when determining that the temperature of the cold water is higher than the indoor temperature, the cooling operation is continued (S13), an operation (thermo ON) of driving the use side fan 27 or the like is performed (S14), and the amount of heat included in the cold water is emitted to the air conditioning target space to cool the cold water.

Meanwhile, when determining that the temperature of the cold water is higher than the temperature of the warm water, the processes after S11 mentioned above are performed. As a result, in the use side heat exchanger 26 of the indoor unit 2 having the indoor temperature equal to or lower than the temperature of the cold water, the cold water discharges the heat absorbed from air of the computer room. At this time, in the indoor unit 2 performing the heating, the flow path switching valves 22*b* and 23*b* are switched (to the cooling side) so that the cold water is circulated (S13). Herein, in the indoor unit 2 that performs the heating having the indoor temperature higher than the temperature of the cold water, in the manner of S12, the use side fan 27 or the like is stopped while continuing the heating.

Herein, in an actual air-conditioning apparatus, in the configured water circulation path, the water pipe 5 occupies most of the path length thereof. Thus, by performing the switchover, water circulating as the warm water is mixed with the cold water and is circulated. At this time, by mixing the cold water with the warm water, the temperature of the cold water is lowered.

In this manner, the warm water having the low temperature is mixed with the cold water, and the heat of the cold water is discharged by the use side heat exchanger 26 of the indoor unit 2 that has an indoor temperature equal to or lower than the temperature of the cold water. At this time, in order to facilitate the heat adsorption (the cooling energy supply) from air of the computer room through the cold water and the heat emission in another indoor unit 2, the cold pump 21*a* circulates water by the maximum driving, and the use side heat exchangers 26 of each piece of indoor unit 2 determine the heat-exchangeable capacity so as to match the amount of heat of the water to be transported by the circulation. Furthermore, by driving the use side fan 27, the heat exchange is promoted.

Herein, when the temperature of the cold water is higher than the temperature of the warm water, the indoor unit 2 having the indoor temperature lower than the temperature of the cold water is operated, and the heat absorbed from air of the computer room is discharged. For example, in order to circulate the warm water having the low temperature in the indoor unit 2*a*, the flow path switching valves 22*a* and 23*a* may be switched over. In this case, the hot pump 21*b* serves as the cold pump 21*a*, and the warm water is circulated as the cold water.

The processes of S2 to S15 mentioned above are performed in each piece of indoor unit 2 (S16). Moreover, when determining that the processes are performed on all the indoor unit 2 performing the heating or the cooling, it is determined whether or not an indoor unit 2 performing the heating is present (S17). If indoor unit 2 performing the heating is present, the hot pump 21*b* is maintained as it is (S18).

Meanwhile, if there is no indoor unit 2 performing the heating, it is determined whether or not the supply capability (the cooling total capability) of the amount of heat required for the indoor unit 2 performing the cooling is greater than the amount of heat (the cold pump capacity) that can be supplied by the amount of water transportable by the cold pump 21*a* (S19).

For example, as mentioned above, when the temperature of the cold water is higher than the temperature of the warm water, the cold pump 21*a* is driven to the maximum. However, when the heat of the cold water cannot be emitted but the temperature of the cold water is increased, the flow speed is increased and may exceed the cold pump capacity. Thus, when determining that the cooling total capability is greater than the cold pump capacity, the flow path switching valves 22 and 23 are switched over, commonly, the circulation path divided into two systems is formed into one system, and the cold water is also circulated in the hot pump 21*b* (S20). Moreover, the discharging flow rate of the hot pump 21*b* and the cold pump 21*a* is controlled (S21). The processes mentioned above are repeatedly performed.

Figure 6:
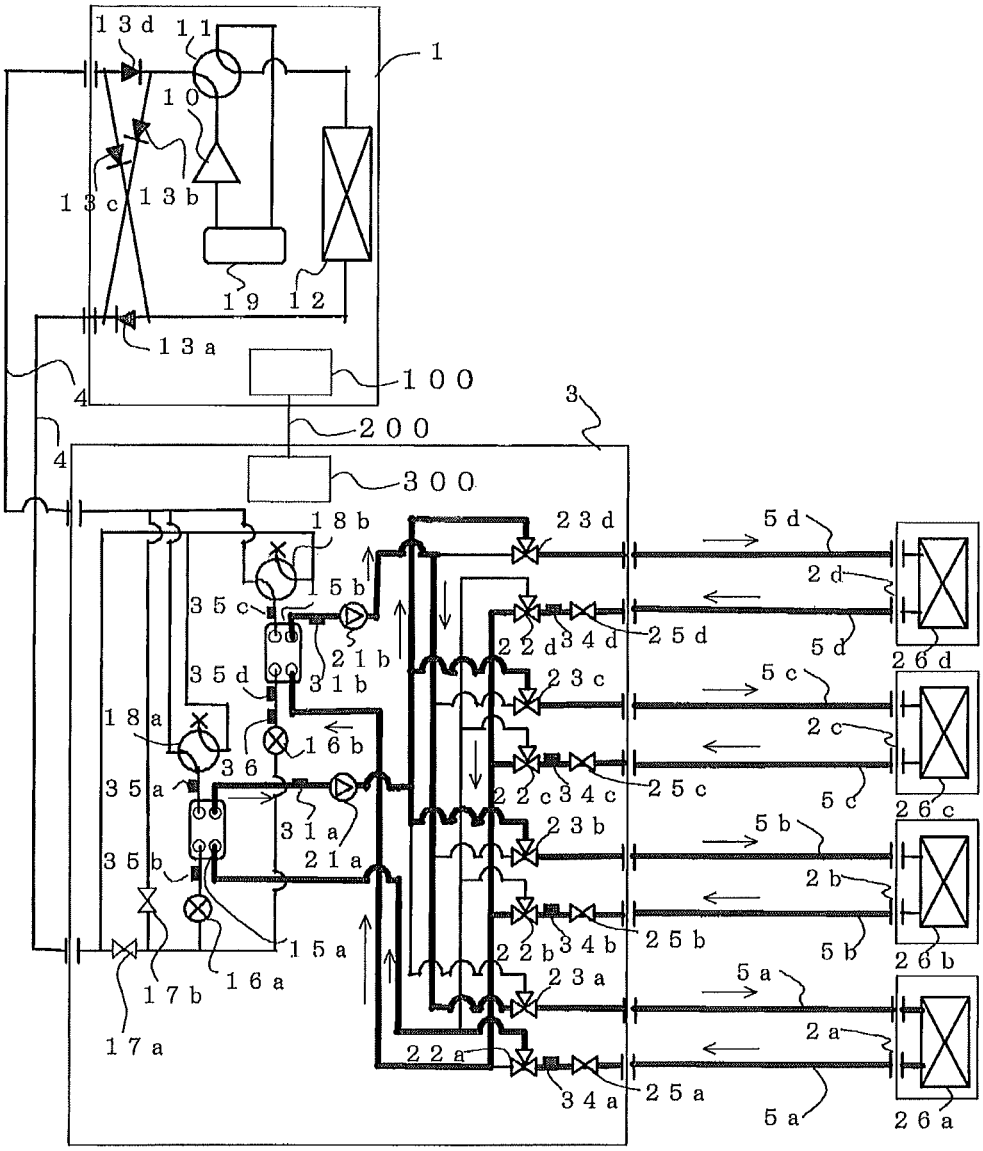
FIG. 6 is a diagram that shows the circulation of water in S20.

FIG. 6 is a diagram that shows the circulation of water in S20. In FIG. 6, a case will be described where, in the use side heat exchanger 26*a*, the heat absorbed from air of the computer room is emitted to the use side heat exchangers 26*b* to 26*d*. At this time, the flow path switching valve 22*a* is switched over such that water from the hot pump 21*b* related to the heat emission flows in the use side heat exchanger 26*a*, and the flow path switching valve 23*a* is switched over such that water related to the heat adsorption from air of the computer room flows to the cold pump 21*a*. Meanwhile, the flow path switching valves 22*b* to 22*d* are switched over such that water from the cold pump 21*a* related to the heat adsorption flows in the use side heat exchangers 26*b* to 26*d*, and the flow path switching valves 23*b* to 23*d* are switched over such that water related to the heat emission flows to the hot pump 21*b*. Water is circulated such that the use side heat exchanger 26*a* of the computer room indoor unit is connected to other use side heat exchangers 26*b* to 26*d* in series. As a result, it is possible to perform the heat adsorption in the use side heat exchanger 26*a* and the waste heat in the use side heat exchangers 26*b* to 26*d* without blending (mixing) water in the intermediate heat exchanger 15.

Herein, the flow of water may be switched over such that water from the cold pump 21*a* flows in the use side heat exchanger 26*a* in the flow path switching valve 22*a*, and water related to the heat adsorption from air of the computer room flows to the hot pump 21*b* in the flow path switching valve 23*a*. At this time, the flow path switching valves 22*b* to 22*d* are switched over such that water from the hot pump 21*b* flows in the use side heat exchangers 26*b* to 26*d*, and the flow path switching valves 23*b* to 23*d* are switched over such that water related to the heat emission flows to the cold pump 21*a*.

As above, according to the air-conditioning apparatus of the embodiment 2, when the temperature of the cold water is lower than the set temperature of the computer room, the cooling or the heating is also continued in another indoor unit 2. Thus, it is also possible to maintain the temperature of the air conditioning target space in another indoor unit 2. At this time, since the capability is suppressed in regard to the indoor unit 2 performing the cooling other than the indoor unit 2*a*, it is possible to supply as much cooling energy as possible to the computer room, with respect to the indoor unit 2*a* over a long time. Furthermore, when the relay unit side control device 300 determines that the temperature of the cold water is higher than the temperature of the warm water in regard to the cold water and the warm water respectively circulating in the circulation paths of each system, the flow path switching valves 22 and 23 are switched over, such that the warm water can also be circulated, and thus, the temperature of air of the computer room can further be maintained over a long time.

In addition, when the temperature of the cold water is equal to or higher than the set temperature of the computer room, in a case where the temperature of the cold water is higher than the indoor temperature in the indoor unit 2 performing the cooling, the operation is stopped by thermo OFF. Thus, it is possible to prevent the cold water from absorbing the heat from air of the air conditioning target space. Moreover, when determining that the cooling total capability is greater than the cold pump capacity, the cold water is also circulated in the hot pump 21*b*. Thus, it is possible to supply the amount of heat required for maintaining the temperature of the computer room over as long a time as possible.

Particularly, in the air-conditioning apparatus of the embodiment 2, a configuration is adopted in which the water circulation circuit connected by the water pipe 4 or the like can be divided into the circulation path by two systems of the cold water and the warm water by switching the flow path switching valves 22 and 23. For this reason, for example, even when it is impossible to discharge the amount of heat of the cold water in the intermediate heat exchanger 15*a*, it is possible to perform the process, such as a process of discharging the amount of heat by the use side heat exchanger 26 of the indoor unit 2 performing the heating by switching the flow path switching valves 22 and 23.

Embodiment 3

In the aforementioned embodiments, a case is described where the intermediate heat exchanger 15*b* heats water as the heat medium and converts water into the warm water, and the intermediate heat exchanger 15*a* cools the warm water and circulates the same as the cold water. For example, water may be cooled (heated) in the respective intermediate heat exchangers 15, and water having different temperatures may be circulated in the circulation paths in each system. For example, when both intermediate heat exchangers 15 cool water, during an emergency operation, water related to the cooling is circulated in both systems, and thus, the temperature of air of the computer room can be maintained for a long time.

Furthermore, in the indoor unit 2, an air-conditioning apparatus is described as an example which can concurrently mix and perform the cooling and the heating, but the present invention is not limited thereto. For example, even in regard to an air-conditioning apparatus performing only the cooling or the heating, the indoor unit 2 (the use side heat exchanger 26) performing the cooling operation or the heating operation is preferentially set. Moreover, in the case of the emergency operation, it is possible to cause the preferentially set indoor unit 2 to perform the cooling operation or the heating operation.

Furthermore, in the embodiments mentioned above, the indoor unit 2*a* for the computer room performing the cooling is described as the indoor unit 2 that is preferentially operated during emergency operation, but the indoor unit 2 performing the heating operation during emergency operation may be preferentially set.

In addition, in the embodiments mentioned above, the cooling of the cold water and the heating of the warm water circulating in the water circulation circuit are performed by the refrigeration cycle device constituting the refrigeration cycle using the intermediate heat exchangers 15*a* and 15*b*. However, the heating and the cooling are not limited to the refrigeration cycle device, and the cooling of the cold water and the heating of the warm water may be performed using another heating and cooling means.

INDUSTRIAL APPLICABILITY

In the embodiments mentioned above, an application to an air-conditioning apparatus is described. The present invention can also be used to maintain a cold state, for example, in a cold device, without being limited to the apparatus. Furthermore, the present invention can also be applied to other devices that constitute the heat medium circulation circuit such as a heat pump device.

REFERENCE SIGNS LIST

1 heat source device (outdoor unit), 2*a*, 2*b*, 2*c*, 2*d* indoor unit, 3 relay unit, 4 refrigerant pipe, 5*a*, 5*b*, 5*c*, 5*d* water pipe, 10 compressor, 11 four-way valve, 12 heat source side heat exchanger, 13*a*, 13*b*, 13*c*, 13*d* check valve, 15*a*, 15*b* intermediate heat exchanger, 17*a*, 17*b* opening and closing valve, 18*a*, 18*b* refrigerant flow path switching valve, 19 accumulator, 21*a*, 21*b* pump (water feeding device), 22*a*, 22*b*, 22*c*, 22*d* flow path switching valve, 23*a*, 23*b*, 23*c*, 23*d* flow path switching valve, 25*a*, 25*b*, 25*c*, 25*d* flow rate adjusting valve, 26*a*, 28*b*, 26*c*, 26*d* use side heat exchanger, 27*a*, 27*b*, 27*c*, 27*d* use side fan, 31*a*, 31*b* first temperature sensor, 34*a*, 34*b*, 34*c*, 34*d* second temperature sensor, 35*a*, 35*b*, 35*c*, 35*d* third temperature sensor, 36 pressure sensor, 100 outdoor unit side control device, 200 signal line, 300 relay unit side control device

The invention claimed is:

1. An air-conditioning apparatus comprising:

a refrigeration cycle device connecting a compressor that compresses a refrigerant, a refrigerant flow path switching device that switches a circulation path of the refrigerant, a heat source side heat exchanger that exchanges heat of the refrigerant, an expansion device that regulates a pressure of the refrigerant, and intermediate heat exchangers by piping to constitute a refrigeration cycle;

a heat medium circulation circuit including, a plurality of heat medium feeding devices for circulating a heat medium, the intermediate heat exchangers exchange heat directly between the refrigerant and the heat medium for heating or cooling the heat medium, a plurality of use side heat exchangers exchanging heat between air, which is a heat exchange target, and the heat medium by-piping and a plurality of flow path switching devices switching the path for supplying the heat medium to each of the selected use side heat exchangers; and a control device that selects a use side heat exchanger absorbing heat into the heat medium and a use side heat exchanger emitting heat from the heat medium and controls to circulate the heat medium through both of the absorbing use side heat exchanger and the emitting use side heat exchanger, when determining that the heat medium cannot exchange heat in the intermediate heat exchanger, the control device controlling the switching by the flow path switching devices, wherein at least one of the use side heat exchangers is arranged in another circulation path that does not include the use side heat exchanger absorbing heat, and emits heat from the heat medium to air which is a heat exchange target, and the control device switches the flow path switching devices so that the flow of the heat medium related to the other circulation path circulates in the use side heat exchanger absorbing heat, when at least one temperature sensor senses that a temperature of the heat medium circulating in the circulation path including the use side heat exchanger absorbing heat is higher than a temperature of the heat medium related to the other circulation path when it is determined that the heat medium cannot exchange heat in the intermediate heat exchanger.

2. The air-conditioning apparatus of claim 1, wherein the use side heat exchanger absorbing heat into the heat medium is arranged in an indoor unit for a computer room, and the use side heat exchanger that emits heat from the heat medium exchanges heat with outdoor air.

3. The air-conditioning apparatus of claim 1, wherein the control device switches the flow path switching devices to make one circulation path in the heat medium circulation circuit, when determining that capability of the heat medium feeding device circulating the heat medium of the circulation path including a predetermined use side heat exchanger is insufficient.

4. The air-conditioning apparatus of claim 1, wherein the control device selects the use side heat exchanger absorbing heat into the heat medium and the use side heat exchanger emitting heat from the heat medium and controls to circulate the heat medium through both of the absorbing use side heat exchanger and the emitting use side heat exchanger, when determining that the heat medium cannot exchange heat in the intermediate heat exchanger because the compressor is not operating.

* * * * *